US012433365B2

(12) United States Patent
Lin et al.

(10) Patent No.: US 12,433,365 B2
(45) Date of Patent: Oct. 7, 2025

(54) TRIBOELECTRIC NANOSENSOR AND GAIT MEASUREMENT METHOD

(71) Applicant: National Tsing Hua University, Hsinchu (TW)

(72) Inventors: Zong-Hong Lin, Hsinchu (TW); Cheng Yeh, Hsinchu (TW); Po-Han Wei, Hsinchu (TW); Fu-Cheng Kao, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 342 days.

(21) Appl. No.: 17/984,702

(22) Filed: Nov. 10, 2022

(65) Prior Publication Data

US 2024/0065372 A1 Feb. 29, 2024

(30) Foreign Application Priority Data

Aug. 25, 2022 (TW) ..... 111132154

(51) Int. Cl.
*A43B 7/144* (2022.01)
*A43B 7/145* (2022.01)

(52) U.S. Cl.
CPC ..... *A43B 7/144* (2013.01); *A43B 7/145* (2013.01)

(58) Field of Classification Search
CPC ..... A43B 3/44
See application file for complete search history.

(56) References Cited

U.S. PATENT DOCUMENTS

2017/0157613 A1 6/2017 Li et al.
2021/0313389 A1* 10/2021 Boyd ..... H02N 11/008

FOREIGN PATENT DOCUMENTS

TW 200821553 A 5/2008
TW 201641923 A 12/2016
TW I564446 B * 1/2017

OTHER PUBLICATIONS

Chang et al. (TW 1564446 B), A Wearable Cloth Device That Integrates Power Generation and Storage Functions, Jan. 2017, FIT Machine Translation (Year: 2017).*

* cited by examiner

*Primary Examiner* — Erika J. Villaluna
(74) *Attorney, Agent, or Firm* — The Webb Law Firm

(57) ABSTRACT

A triboelectric nanosensor includes an elastic body, a liquid metal and a wire. The elastic body includes an inner wall surrounding a chamber, and a plurality of biomimetic shark placoid scale-shaped microstructures adjacent to each other and disposed at at least one portion of the inner wall. The liquid metal is located within the chamber and surrounded by the elastic body. The wire is electrically connected to the liquid metal. The elastic body is pressed to be deformed and restores to change a contact state between the liquid metal and the biomimetic shark placoid scale-shaped microstructures, thereby allowing a plurality of electrons to flow into the liquid metal via the wire or to flow out from the liquid metal via the wire.

16 Claims, 16 Drawing Sheets
(4 of 16 Drawing Sheet(s) Filed in Color)

TRIBOELECTRIC NANOSENSOR AND GAIT MEASUREMENT METHOD

CROSS REFERENCE TO RELATED APPLICATION

This application claims priority to Taiwanese Application Number 111132154 filed Aug. 25, 2022, the disclosure of which is hereby incorporated by reference in its entirety.

BACKGROUND OF THE INVENTION

Field of the Invention

The present disclosure relates to a sensor and a measurement method. More particularly, the present disclosure relates to a triboelectric nanosensor and a gait measurement method.

Description of Related Art

Human walking is a dynamic and continuous action, which provides a basis for biological force analysis, including muscle power, body balance and gait symmetry. The aforementioned indexes are even relative to some important illnesses, such as Parkinson's disease (PD) and neuromuscular disease damages. A force plate is commonly used for measuring the gait. Although this kind of method has high measuring accuracy, it lacks real-time monitor and feedback, and it is not favorable for long term and continuous gait measurement. In addition, a specific place is required for operating the force plate, which is not favorable for the real-time measurement.

Therefore, a gait sensor is developed to be set in a sock or an insole. The gait sensor can be a resistance-type sensor or a voltage-type sensor; however, an outer power source is required for these kinds of gait sensors, and the power source becomes a problem for the gait sensor.

Recently, triboelectric nanogenerators having a powering function are developed, and the self-powering characteristic is favorable for manufacturing the triboelectric nanosensors for obtaining signals in long term. For the triboelectric nanosensors, signals can be generated via contacting and separating between the solid and liquid. However, because of the surface tension, the surfaces of the solid and liquid will adhere to each other, and the deviations of the measuring signals are generated.

Hence, how to improve the aforementioned problems becomes a target that the practitioners pursued.

SUMMARY OF THE INVENTION

According to one aspect of the present disclosure, a triboelectric nanosensor includes an elastic body, a liquid metal and a wire. The elastic body includes an inner wall surrounding a chamber, and a plurality of biomimetic shark placoid scale-shaped microstructures adjacent to each other and disposed at at least one portion of the inner wall. The liquid metal is located within the chamber and surrounded by the elastic body. The wire is electrically connected to the liquid metal. The elastic body is pressed to be deformed and restores to change a contact state between the liquid metal and the biomimetic shark placoid scale-shaped microstructures, thereby allowing a plurality of electrons to flow into the liquid metal via the wire or to flow out from the liquid metal via the wire.

According to another aspect of the present disclosure, a gait measurement method includes a triboelectric nanosensor providing step, a signal collecting step, a time ratio calculating step and a time ratio comparing step. In the triboelectric nanosensor providing step, four triboelectric nanosensors are disposed at a sock or an insole, the four triboelectric nanosensors correspond to a big toe, a first metatarsal, a fourth metatarsal and a heel of a foot, respectively, and each of the triboelectric nanosensors is signally connected to a processor. In the signal collecting step, a signal is generated by each of the triboelectric nanosensors based on a force of the foot. In the time ratio calculating step, the triboelectric nanosensors correspond to the big toe, the first metatarsal and the fourth metatarsal are defined as 1st to 3rd measuring points, respectively, and the triboelectric nanosensor corresponds to the heel is defined as a base point. The processor calculates $Ra_i=(TX_i-TH)/CY$, $Ra_i$ represents a time ratio of the $it^{th}$ measuring point, $TX_i$ represents a trigger time of the $it^{th}$ measuring point, CY represents a difference between a former one of the trigger times of the base point and a latter one of the trigger times of the base point, and i represents a variant and is an integer ranged from 1 to 3. The trigger time indicates a time point that the signal stars, and the time ratios of the 1st to 3rd measuring points are obtained. In the time ratio comparing step, the time ratios are compared to three ranges, respectively, by the processor to confirm whether each of the time ratios is within each of the range.

BRIEF DESCRIPTION OF THE DRAWINGS

The patent or application file contains at least one drawing executed in color. Copies of this patent or patent application publication with color drawing(s) will be provided by the Office upon request and payment of the necessary fee. The present disclosure can be more fully understood by reading the following detailed description of the embodiment, with reference made to the accompanying drawings as follows.

DESCRIPTION OF THE INVENTION

It will be understood that when an element (or mechanism or module) is referred to as being "disposed on", "connected to" or "coupled to" another element, it can be directly disposed on, connected or coupled to the other element, or intervening elements may also be present. In contrast, when an element is referred to as being "directly disposed on", "directly connected to" or "directly coupled to" another element, there are no intervening elements present.

In addition, the terms first, second, third, etc. are used herein to describe various elements or components, these elements or components should not be limited by these terms. Consequently, a first element or component discussed below could be termed a second element or component.

Figure 1:
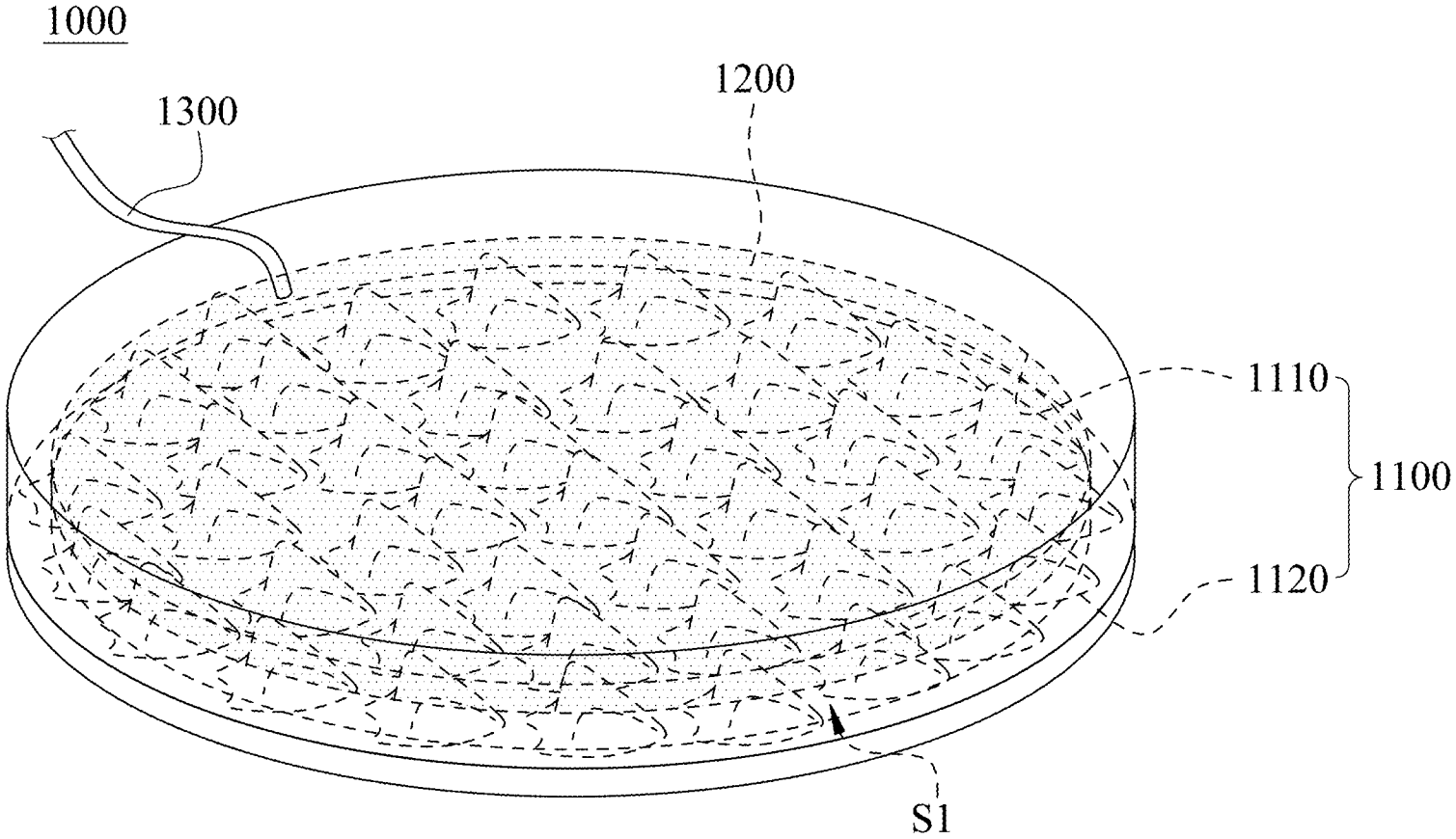
FIG. 1 is a three-dimensional schematic view of a triboelectric nanosensor according to one embodiment of the present disclosure.
Figure 2:
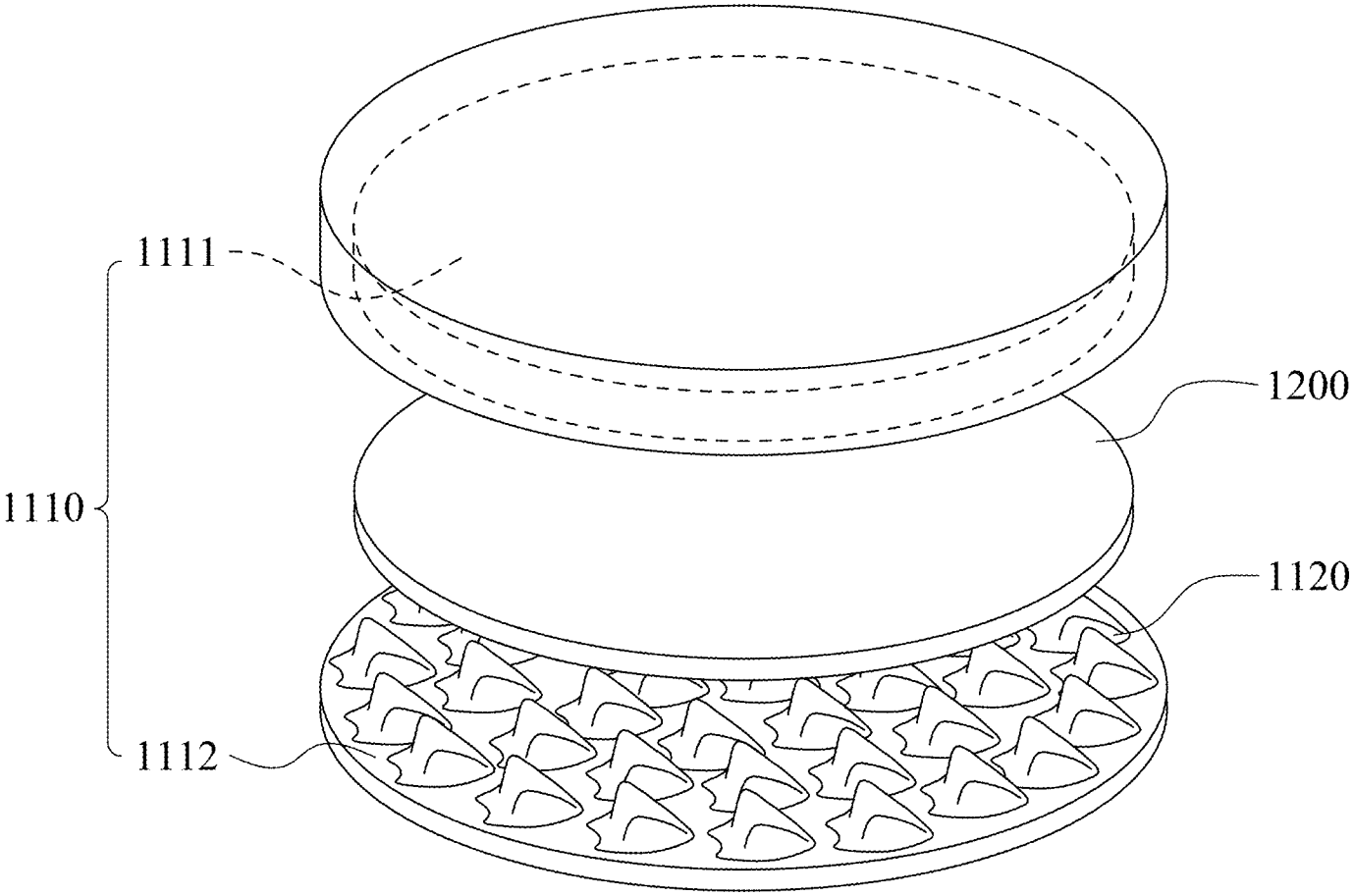
FIG. 2 is a schematic view showing an upper layer, a liquid metal and a lower layer of the triboelectric nanosensor of FIG. 1 in a separation state.

FIG. 1 is a three-dimensional schematic view of a triboelectric nanosensor 1000 according to one embodiment of the present disclosure. FIG. 2 is a schematic view showing an upper layer 1111, a liquid metal 1200 and a lower layer 1112 of the triboelectric nanosensor 1000 of FIG. 1 in a separation state. A triboelectric nanosensor 1000 includes an elastic body 1100, a liquid metal 1200 and a wire 1300. The elastic body 1100 includes an inner wall 1110 surrounding a chamber S1, and a plurality of biomimetic shark placoid scale-shaped microstructures 1120 adjacent to each other and disposed at at least one portion of the inner wall 1110. The liquid metal 1200 is located within the chamber S1 and surrounded by the elastic body 1100. The wire 1300 is electrically connected to the liquid metal 1200. The elastic body 1100 is pressed to be deformed and restores to change a contact state between the liquid metal 1200 and the biomimetic shark placoid scale-shaped microstructures 1120, thereby allowing a plurality of electrons $e^-$ (shown in FIG. 4) to flow into the liquid metal 1200 via the wire 1300 or to flow out from the liquid metal 1200 via the wire 1300.

Therefore, the biomimetic shark placoid scale-shaped microstructures 1120 are favorable for reducing the adhesion of the liquid metal 1200, thereby increasing the output stability of the triboelectric nanosensor 1000, and avoiding the errors of the triboelectric nanosensor 1000 as being applied for measurement to increase the accuracy. Details of the triboelectric nanosensor 1000 will be further described hereinafter.

As shown in FIGS. 1 and 2, the elastic body 1100 is flat plate-shaped and is made of silicone, especially Ecoflex 00-30. Since the elastic body 1100 is elastic and flexible, it is stretchable after forced. As the triboelectric nanosensor 1000 is disposed at the foot and is configured for the foot to be trampled, the elastic body 1100 is favorable for providing a better touching feeling. The inner wall 1110 of the elastic body 1100 can include an upper layer 1111 and a lower layer 1112, and the biomimetic shark placoid scale-shaped microstructures 1120 can be disposed at the lower layer 1112 and face toward the chamber S1. In other embodiments, the biomimetic shark placoid scale-shaped microstructures can be disposed at the upper layer and the lower layer simultaneously, and the present disclosure is not limited thereto.

Figure 3:
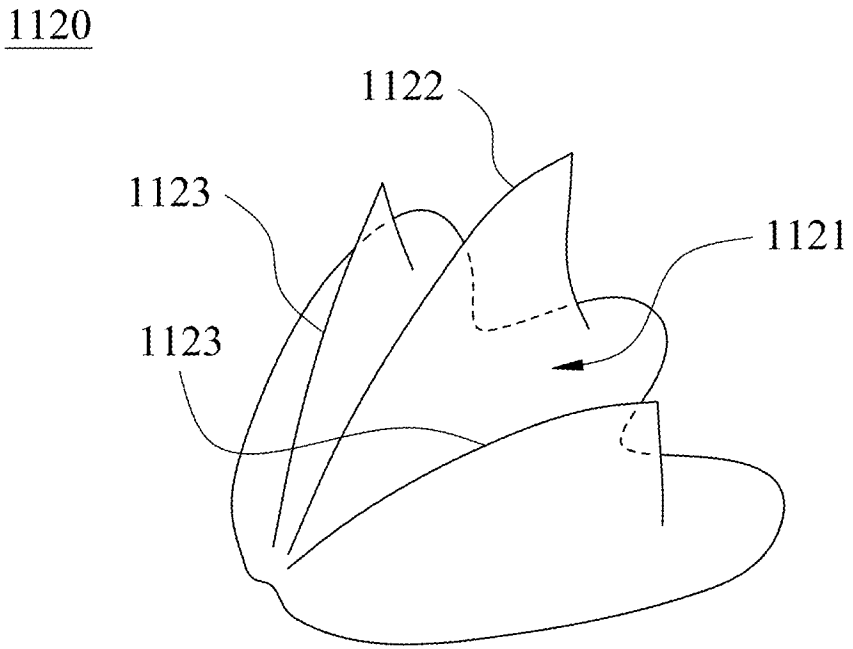
FIG. 3 is a schematic view of biomimetic shark placoid scale-shaped microstructures of the triboelectric nanosensor of FIG. 2.

FIG. 3 is a schematic view of biomimetic shark placoid scale-shaped microstructures 1120 of the triboelectric nanosensor 1000 of FIG. 2. Please refer to FIG. 3 with references of FIGS. 1 and 2, each of the biomimetic shark placoid scale-shaped microstructures 1120 can include a plurality of microgrooves 1121, and a width of each of the microgrooves 1121 is ranged from 45.0 microns to 50.0 microns. Additionally, each of the biomimetic shark placoid scale-shaped microstructures 1120 can include a main-ridge 1122 and two sub-ridges 1123, the main-ridge 1122 is located between the two sub-ridges 1123, and one of the microgrooves 1121 is formed between the main-ridge 1122 and one of the sub-ridges 1123. A height of the main-ridge 1122 is ranged from 9.5 microns to 10.5 micros, and a height of each of the sub-ridges 1123 is ranged from 7.5 microns to 8.5 microns.

To be more specific, each of the biomimetic shark placoid scale-shaped microstructures 1120 is a three-dimensional structure. From a top view thereof, each of the biomimetic shark placoid scale-shaped microstructures 1120 can substantially include a rhombus body, and each of the main-ridge 1122 and the two sub-ridges 1123 protrudes from the surface of the rhombus body to form the two microgrooves 1121 that are relative low-lying. Moreover, each of the biomimetic shark placoid scale-shaped microstructures 1120 may be inclined disposed at the inner wall 1110, and an angle contained therebetween is about 4 degrees to 8 degrees. Hence, from the top view thereof, the biomimetic shark placoid scale-shaped microstructures 1120 may be partially stacked. In the embodiment shown in FIGS. 1 to 3, a molding method may be used to manufacture the biomimetic shark placoid scale-shaped microstructures 1120, but the present disclosure is not limited thereto. Please be noted that the detail structures and the sizes of the biomimetic shark placoid scale-shaped microstructures 1120 may be different; however, the biomimetic shark placoid scale-shaped microstructures 1120 shown in the drawings have the same shape and the same size for concise illustration, the angle is also not shown, and the present disclosure is not limited thereto.

The liquid metal 1200 is made of mercury-free alloy, and is in a liquid state in the room temperature. As the liquid metal 1200 is within the chamber S1, it contacts both the upper layer 1111 and the biomimetic shark placoid scale-shaped microstructures 1120 of the lower layer 1112. However, the liquid metal 1200 may contact a part of each of the biomimetic shark placoid scale-shaped microstructures 1120, such as the main-ridge 1122 and the two sub-ridges 1123, and the contact state may be defined as a first contact state. As the triboelectric nanosensor 1000 is forced and the elastic body 1100 is deformed, the liquid metal 1200 may contact the microgrooves 1121 or even the surface of the root of the rhombus body of each of the biomimetic shark placoid scale-shaped microstructures 1120, and a contact surface can change from the first contact state to a second contact state. After the force is removed, the triboelectric nanosensor 1000 restores and goes back to the first contact state.

Figure 4:
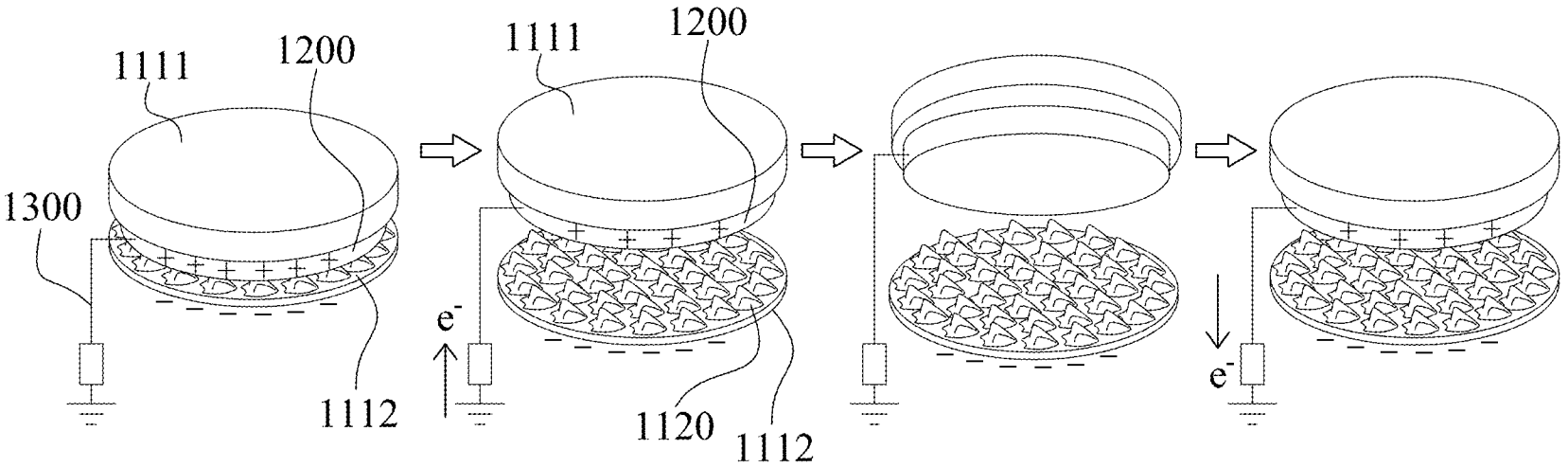
FIG. 4 is an operation of the triboelectric nanosensor of FIG. 1.

FIG. 4 is an operation of the triboelectric nanosensor 1000 of FIG. 1. Please refer to FIG. 4 with references of FIGS. 1 to 3, an output respond of a conventional triboelectric nanosensor is generated based on two continuous phenomenon, contact charging and electrostatic induction. The generation of the electrostatic and polarized surface charges is promoted by the contact charging, and the electrostatic induction induces the charges on the electrode, after which the electrons flow can be driven by the potential difference caused by the material characteristics, thereby generating a voltage and a current. Hence, in the triboelectric nanosensor 1000 of the embodiment, the liquid metal 1200 is served as the electrode, and the upper layer 1111 and the lower layer 1112 are served as the rubbing material. As shown in the left side of FIG. 4, when the upper layer 1111 and the liquid metal 1200 totally contact each other, surface charges are generated. According to the material characteristics, the surface of the liquid metal 1200 will have positive charges, and the lower layer 1112 will have negative charges. Subsequently, as the lower layer 1112 separates from the surface of the liquid metal 1200, the surface charges of the liquid metal 1200 will induce opposite charges to remain in an electric neutrality condition. Hence, a potential difference is generated between the liquid metal 1200 and the ground, and the electrons $e^-$ flow from the ground via the wire 1300 toward the liquid metal 1200 to generate a positive output current. When the distance between the lower layer 1112 and the liquid metal 1200 achieves a maximum value, the potential difference also achieves a maximum value. In the next cycle, as the lower layer 1112 contacts the liquid metal 1200 again, the potential difference becomes small owing to that all the induced charges of the liquid metal 1200 return back to the ground. Therefore, as shown in the right side of FIG. 4, the electrons $e^-$ flow in an opposite direction via the wire 1300. The process continues until the lower layer 1112 totally contacts the liquid metal 1200 to allow the potential difference between the electrode and the ground to be zero. The operation that the triboelectric nanosensor 1000 is forced to change from the first contact state to the second contact state, and returns back to the first contact state after the force is removed can be deem as the operation in FIG. 4.

Figure 5:
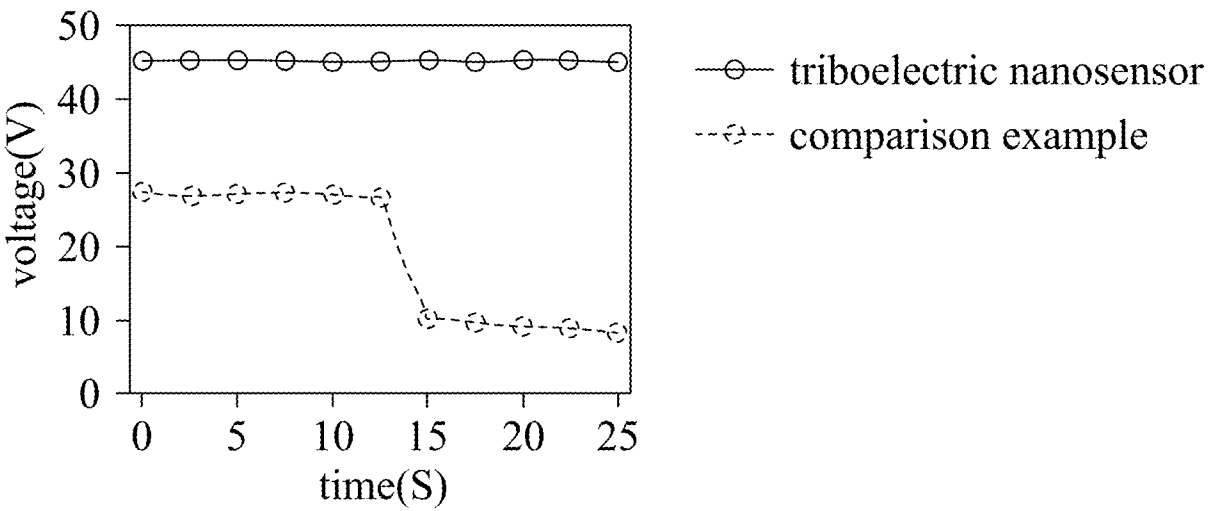
FIG. 5 is a voltage and time trend chart of the triboelectric nanosensor of FIG. 1 and a triboelectric nanosensor of a comparison example.

FIG. 5 is a voltage and time trend chart of the triboelectric nanosensor 1000 of FIG. 1 and a triboelectric nanosensor of a comparison example. Please refer to FIG. 5 with references of FIGS. 1 to 3, the triboelectric nanosensor of the comparison example is similar to the triboelectric nanosensor 1000 shown in FIGS. 1 to 3, but the triboelectric nanosensor of the comparison example does not include the biomimetic shark placoid scale-shaped microstructures 1120 in FIGS. 1 to 3. Because the output current is proportional to the contact surface, as the contact surface is larger, the amount of the surface charges is larger, and the output is increased to increase the voltage. With the configuration of the biomimetic shark placoid scale-shaped microstructures 1120, the lower layer 1112 is more hydrophobic owing to the larger dynamic contact angle, thereby increasing the contact surface. Hence, the voltage output by the triboelectric nanosensor 1000 is larger than the voltage of the triboelectric nanosensor of the comparison example, and the output stability of the triboelectric nanosensor 1000 is better than the output stability of the triboelectric nanosensor of the comparison example.

In order words, with the configuration of the biomimetic shark placoid scale-shaped microstructures 1120, the liquid metal 1200 will not adhere to the lower surface 1112 as separating therefrom, and the contact surface difference is larger owing to that the contact surface in the first contact state is much different from the contact surface in the second contact state. Moreover, the adhesive condition will not increase after a long term usage.

Figure 6:
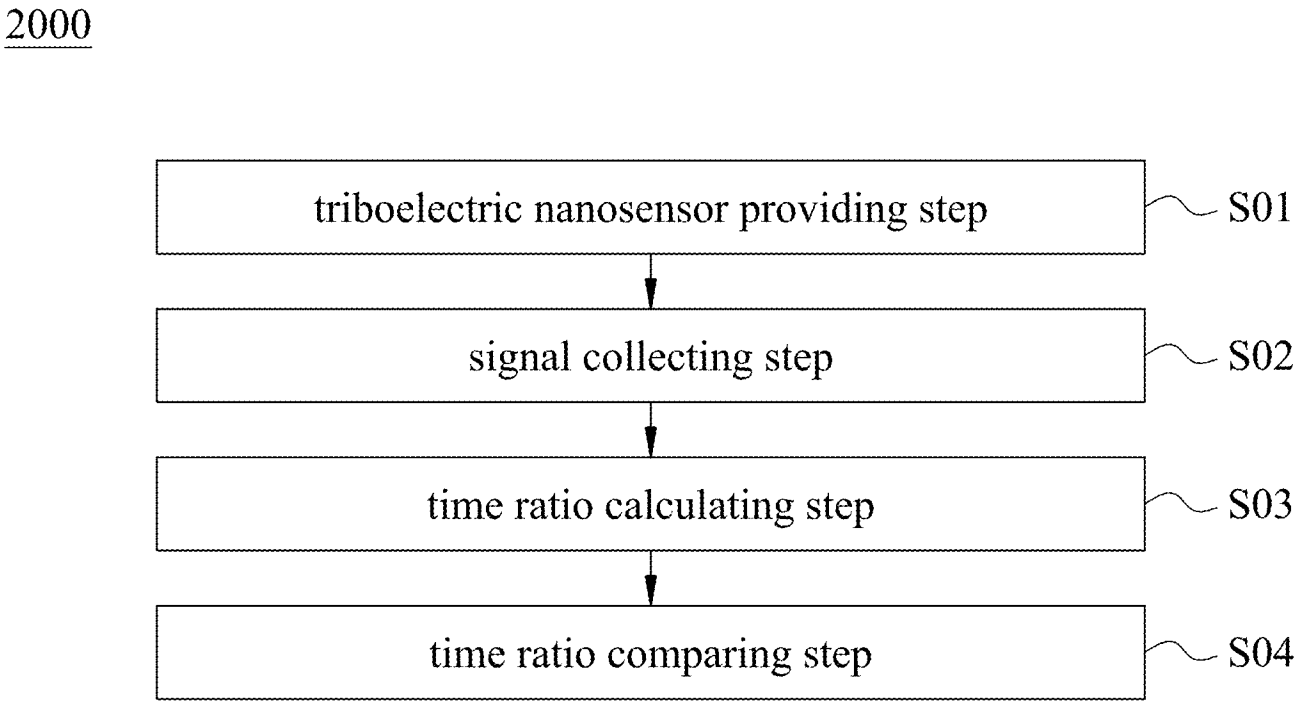
FIG. 6 is a block flow chart of a gait measurement method according to another embodiment of the present disclosure.
Figure 7:
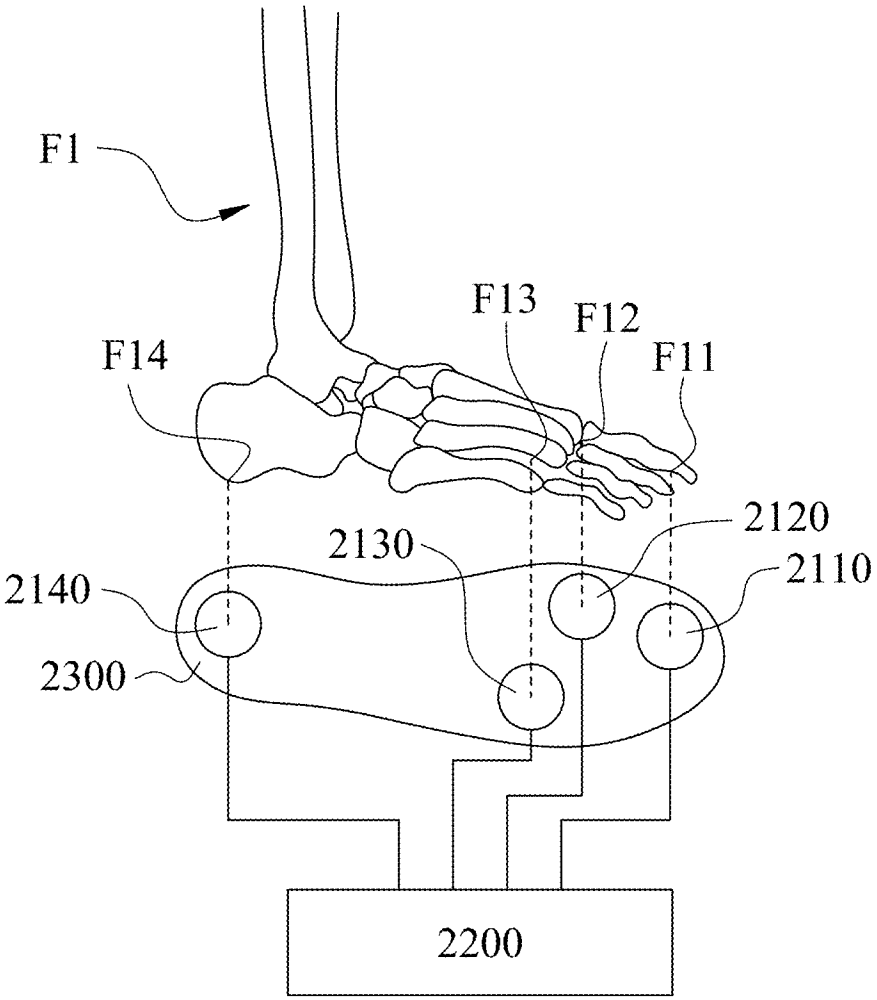
FIG. 7 is a configuration of the gait measurement method of FIG. 6.

FIG. 6 is a block flow chart of a gait measurement method 2000 according to another embodiment of the present disclosure. FIG. 7 is a configuration of the gait measurement method 2000 of FIG. 6. The gait measurement method 2000 includes a triboelectric nanosensor providing step S01, a signal collecting step S02, a time ratio calculating step S03 and a time ratio comparing step S04.

In the triboelectric nanosensor providing step S01, four triboelectric nanosensors 2110, 2120, 2130, 2140 are disposed at a sock 2300, the four triboelectric nanosensors 2110, 2120, 2130, 2140 correspond to a big toe F11, a first metatarsal F12, a fourth metatarsal F13 and a heel F14 of a foot F1, respectively, and each of the triboelectric nanosensors 2110, 2120, 2130, 2140 is signally connected to a processor 2200. Please be noted that, in other embodiments, the triboelectric nanosensors may be disposed at an insole, and the present disclosure is not limited thereto.

In the signal collecting step S02, a signal is generated by each of the triboelectric nanosensors 2110, 2120, 2130, 2140 based on a force of the foot F1.

In the time ratio calculating step S03, the triboelectric nanosensors 2110, 2120, 2130 correspond to the big toe F11, the first metatarsal F12 and the fourth metatarsal F13 are defined as 1st to 3rd measuring points, respectively, and the triboelectric nanosensor 2140 corresponds to the heel F14 is defined as a base point. The processor 2200 calculates $Ra_i=(TX_i-TH)/CY$, $Ra_i$ represents a time ratio of the $it^{th}$ measuring point, $TX_i$ represents a trigger time of the $it^{th}$ measuring point, CY represents a difference between a former one of the trigger times of the base point and a latter one of the trigger times of the base point, and i represents a variant and is an integer ranged from 1 to 3. The trigger time indicates a time point that the signal stars, and the time ratios of the 1st to 3rd measuring points are obtained.

In the time ratio comparing step S04, the time ratios are compared to three ranges, respectively, by the processor 2200 to confirm whether each of the time ratios is within each of the range.

Figure 8:
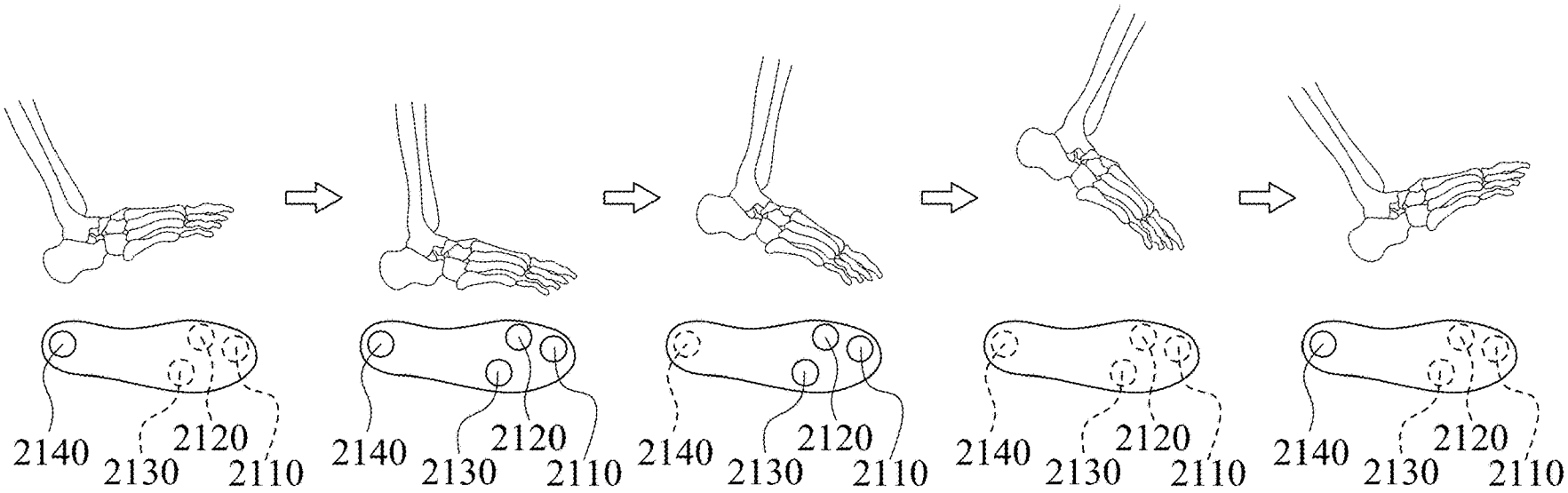
FIG. 8 is a pressing process of the triboelectric nanosensors of the gait measurement method of FIG. 6.
Figure 9:
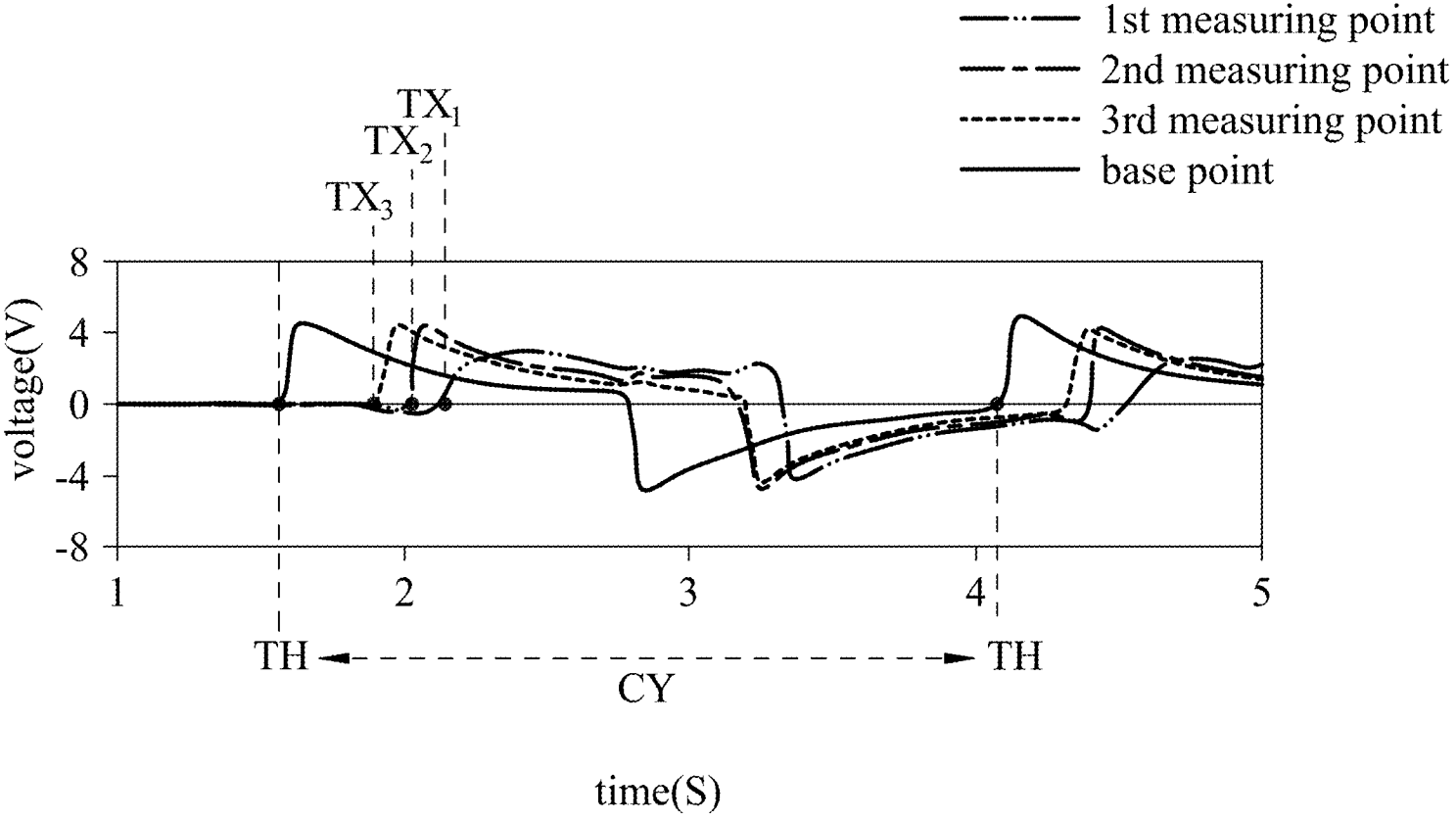
FIG. 9 is a voltage and time trend chart of the triboelectric nanosensors of the gait measurement method of FIG. 6.

FIG. 8 is a pressing process of the triboelectric nanosensors 2110, 2120, 2130, 2140 of the gait measurement method 2000 of FIG. 6. FIG. 9 is a voltage and time trend chart of the triboelectric nanosensors 2110, 2120, 2130, 2140 of the gait measurement method 2000 of FIG. 6. During walking, as shown in FIGS. 7 to 9, the heel F14 will contact the ground first, and the output of the triboelectric nanosensor 2140 is largest in the beginning. As the gravity transfers toward the forefoot, the output of the triboelectric nanosensor 2140 becomes small, and the outputs of the triboelectric nanosensors 2110, 2120, 2130 become larger. When the heel F14 starts to separate from the ground, an obvious pick is generated. As preparing the next step, the power accumulation will cause a tiny upward pick of the forefoot and the toes. Finally, when the foot is lifted to wholly separate from the ground, all the signals return to origin. Consequently, the trigger times $TX_1$, $TX_2$, $TX_3$ of the 1st to 3rd measuring points and two trigger times TH of the base point in two cycles can be obtained according to the signals of the triboelectric nanosensors 2110, 2120, 2130, 2140.

In one embodiment, a plurality of healthy people can walk straightly in two gait cycles for 4 times, thereby establishing a normal model. The range of the time ratio of the 1st measuring point is raged from 0.12 to 0.14, the range of the time ratio of the 2nd measuring point is raged from 0.19 to 0.21, the range of the time ratio of the 3rd measuring point is raged from 0.09 to 0.11, and the data will not be affected by the height, weight and the age of the people.

Figure 11:
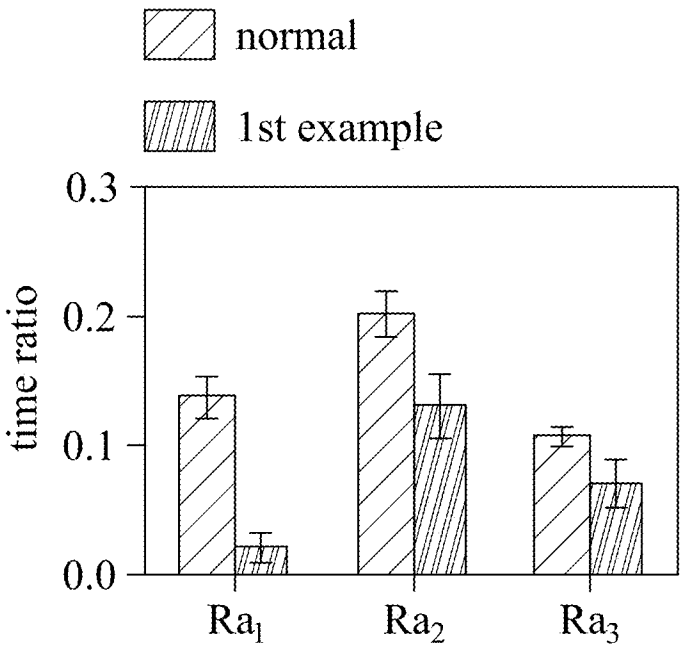
FIG. 11 is a comparison result between the time ratios of 1st to 3rd measuring points of the 1st example and three ranges of a normal model.
Figure 10:
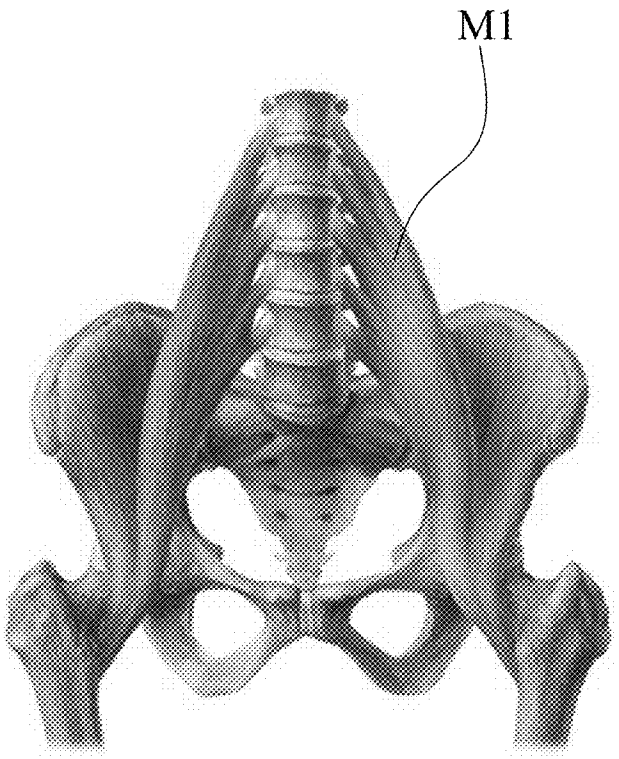
FIG. 10 is a schematic view of an iliopsoas of a 1st example of the gait measurement method of FIG. 6.
Figure 13:
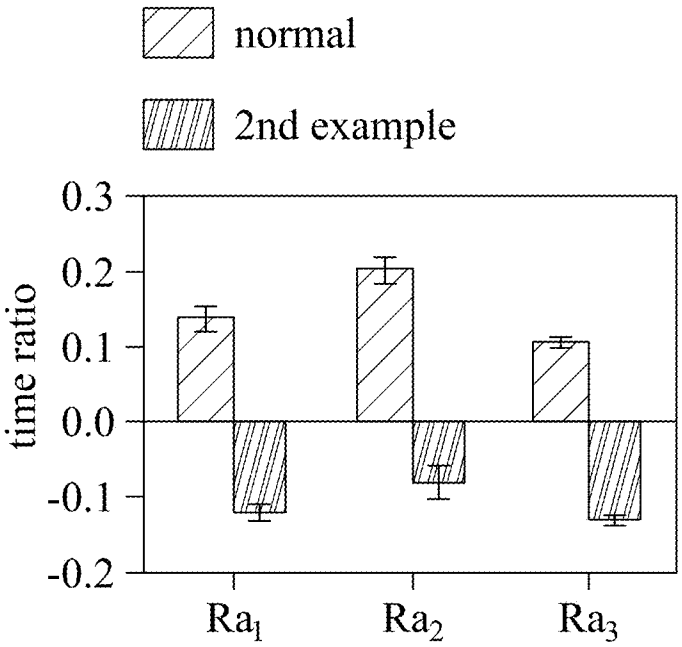
FIG. 13 is a comparison result between the time ratios of 1st to 3rd measuring points of the 2nd example and the three ranges of the normal model.
Figure 12:
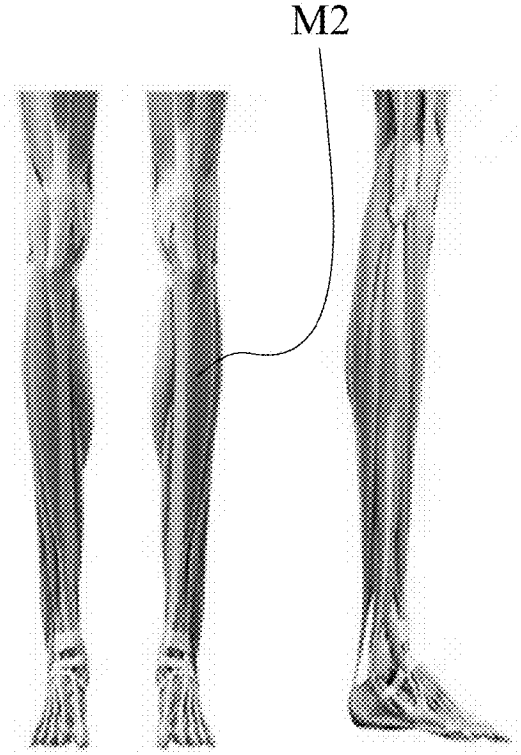
FIG. 12 is a schematic view of a tibialis anterior of a 2nd example of the gait measurement method of FIG. 6.
Figure 15:
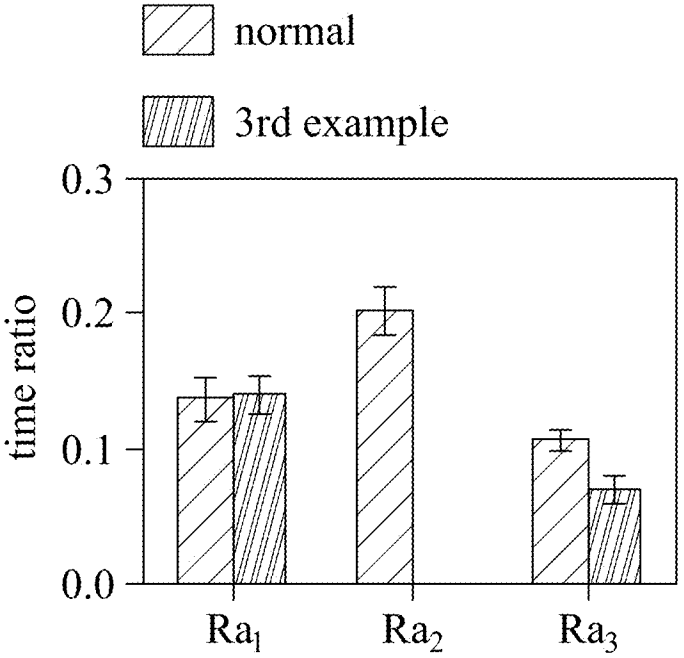
FIG. 15 is a comparison result between the time ratios of 1st to 3rd measuring points of the 3rd example and the three ranges of the normal model.
Figure 14:
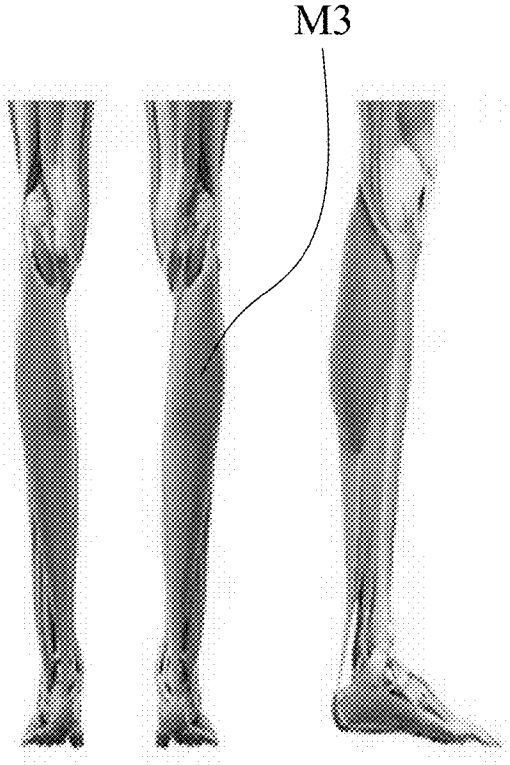
FIG. 14 is a schematic view of a triceps surae of a 3rd example of the gait measurement method of FIG. 6.
Figure 17:
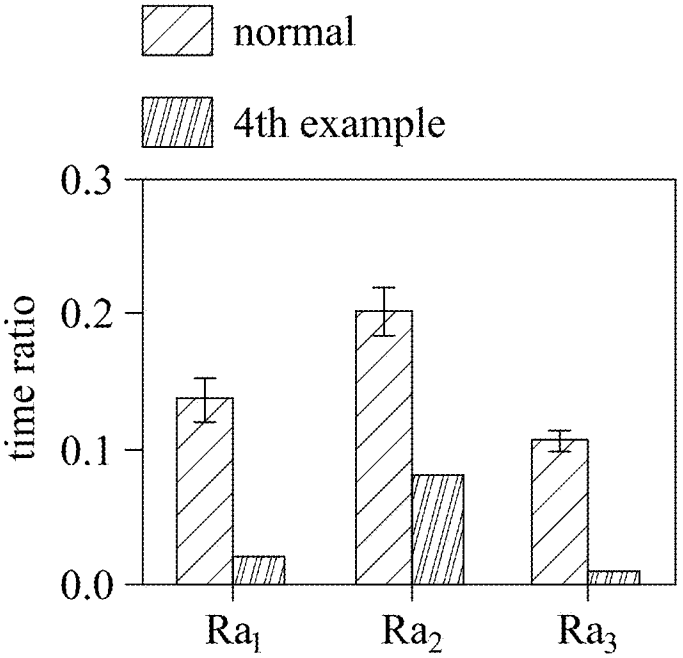
FIG. 17 is a comparison result between the time ratios of 1st to 3rd measuring points of the 4th example and the three ranges of the normal model.
Figure 16:
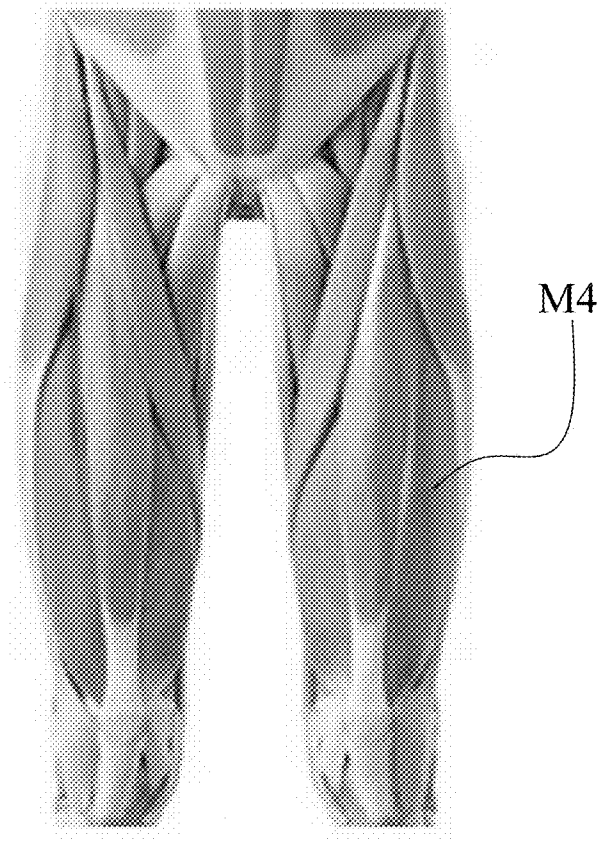
FIG. 16 is a schematic view of vastus muscles of a 4th example of the gait measurement method of FIG. 6.

FIG. 10 is a schematic view of an iliopsoas M1 of a 1st example of the gait measurement method 2000 of FIG. 6. FIG. 11 is a comparison result between the time ratios $Ra_1$, $Ra_2$, $Ra_3$ of 1st to 3rd measuring points of the 1st example and three ranges of a normal model. FIG. 12 is a schematic view of a tibialis anterior M2 of a 2nd example of the gait measurement method 2000 of FIG. 6. FIG. 13 is a comparison result between the time ratios $Ra_1$, $Ra_2$, $Ra_3$ of 1st to 3rd measuring points of the 2nd example and the three ranges of the normal model. FIG. 14 is a schematic view of a triceps surae M3 of a 3rd example of the gait measurement method 2000 of FIG. 6. FIG. 15 is a comparison result between the time ratios $Ra_1$, $Ra_2$, $Ra_3$ of 1st to 3rd measuring points of the 3rd example and the three ranges of the normal model. FIG. 16 is a schematic view of vastus muscles M4 of a 4th example of the gait measurement method 2000 of FIG. 6. FIG. 17 is a comparison result between the time ratios $Ra_1$, $Ra_2$, $Ra_3$ of 1st to 3rd measuring points of the 4th example and the three ranges of the normal model. As shown in the 1st example in FIGS. 10 to 11, a measurement of a person with an abnormal iliopsoas M1 according to the gait measurement method 2000 is taken. The time ratios $Ra_1$, $Ra_2$, $Ra_3$ are 0.02, 0.13 and 0.07, respectively, and are obviously different from the three ranges of the normal model. As shown in the 2nd example in FIGS. 12 to 13, a measurement of a person with an abnormal tibialis anterior M2 according to the gait measurement method 2000 is taken. The time ratios $Ra_1$, $Ra_2$, $Ra_3$ are −0.12, −0.08 and −0.13, respectively, and are obviously different from the three ranges of the normal model. As shown in the 3rd example in FIGS. 14 to 15, a measurement of a person with an abnormal triceps surae M3 according to the gait measurement method 2000 is taken. The time ratios $Ra_1$, $Ra_2$, $Ra_3$ are 0.14, 0 and 0.07, respectively, and are obviously different from the three ranges of the normal model. As shown in the 4th example in FIGS. 16 to 17, a measurement of a person with abnormal vastus muscles M4 according to the gait measurement method 2000 is taken. The time ratios $Ra_1$, $Ra_2$, $Ra_3$ are 0.02, 0.08 and 0.01, respectively, and are obviously different from the three ranges of the normal model. Therefore, the time ratios of the 1st to 3rd measuring points of the gait measurement method 2000 are favorable for assisting the professionals to judge whether the relative muscles are abnormal.

Figure 18:
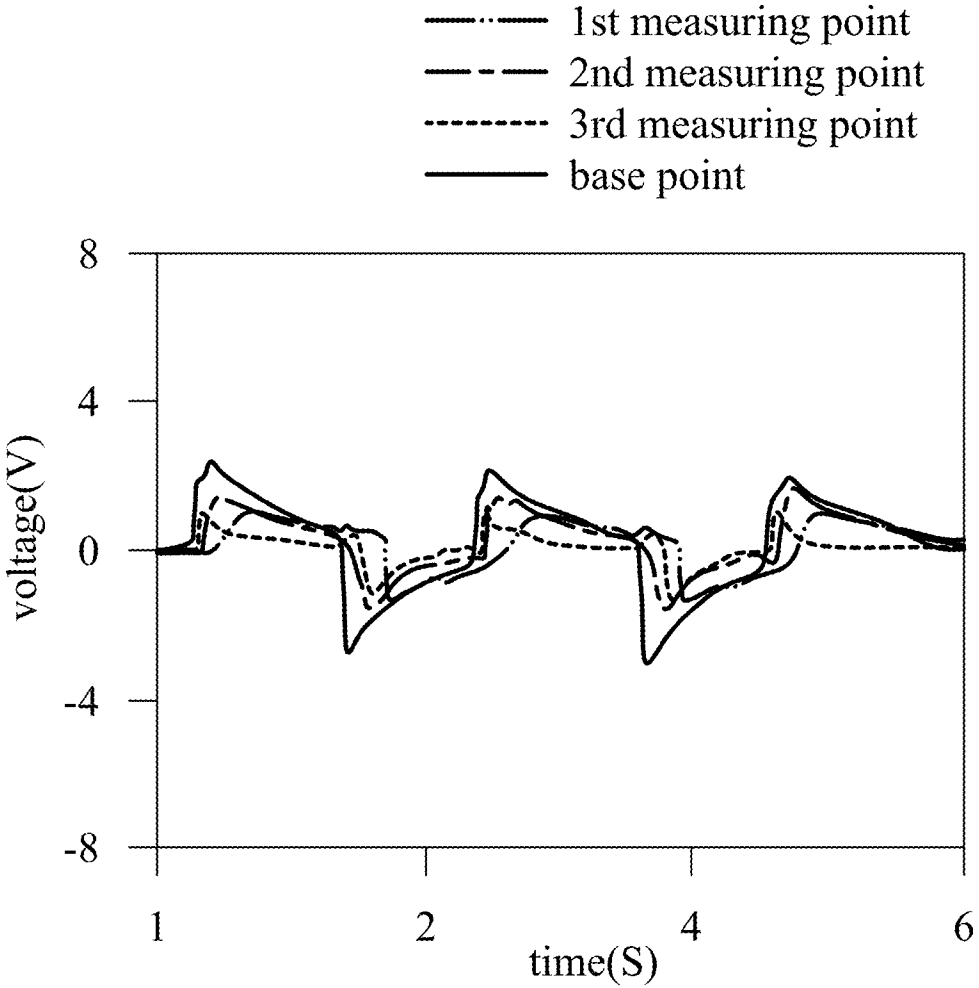
FIG. 18 is a voltage and time trend chart of triboelectric nanosensors of a 5th example of the gait measurement method of FIG. 6.
Figure 19:
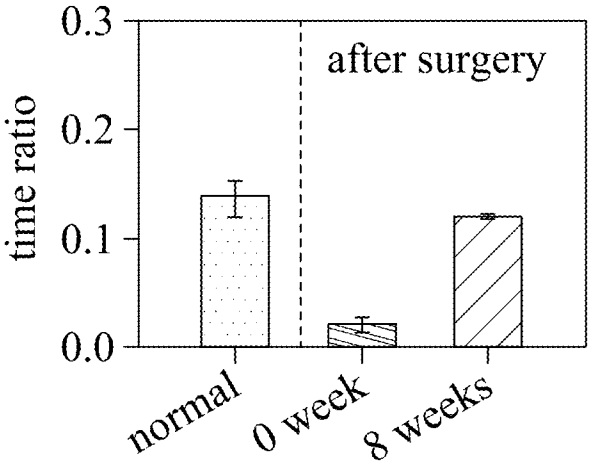
FIG. 19 is a comparison result between the time ratio of a 1st measuring point of the 5th example and one range of the normal model.
Figure 20:
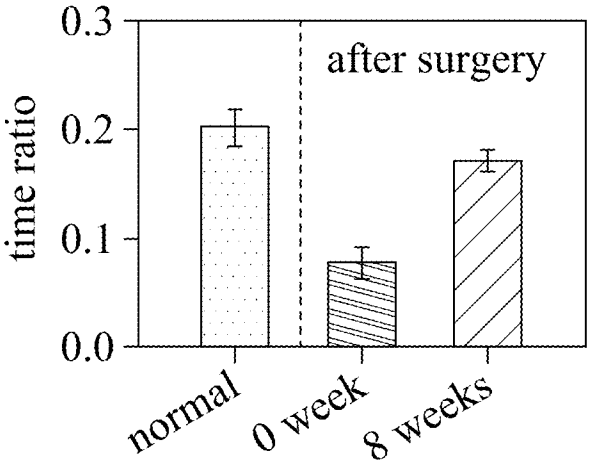
FIG. 20 is a comparison result between the time ratio of a 2nd measuring point of the 5th example and one range of the normal model.
Figure 21:
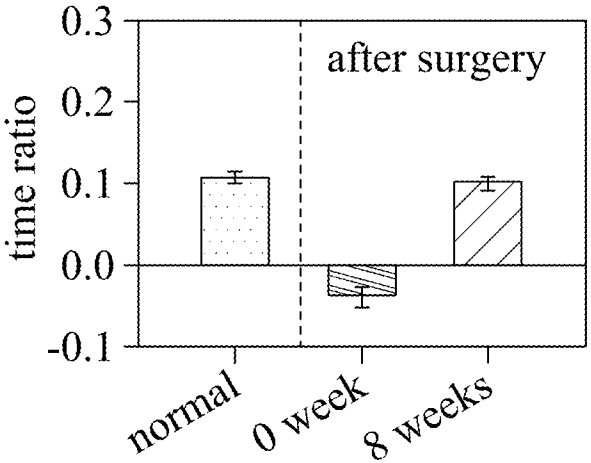
FIG. 21 is a comparison result between the time ratio of a 3rd measuring point of the 5th example and one range of the normal model.

FIG. 18 is a voltage and time trend chart of triboelectric nanosensors 2110, 2120, 2130, 2140 of a 5th example of the gait measurement method 2000 of FIG. 6. FIG. 19 is a comparison result between the time ratio of a 1st measuring point of the 5th example and one range of the normal model. FIG. 20 is a comparison result between the time ratio of a 2nd measuring point of the 5th example and one range of the normal model. FIG. 21 is a comparison result between the time ratio of a 3rd measuring point of the 5th example and one range of the normal model. In the 5th example, the tested person has a torn anterior cruciate ligament, and the torn anterior cruciate ligament may cause the loss of peripheral nerve reflexes that results in atherogenic muscle inhibition, which inhibits the contraction of the quadriceps muscles and produces knee flexion. Hence, the first and fourth metatarsals and the heel may contact the ground simultaneously, and the gait is different from a normal person. After measurement, the time ratios of the 1st to 3rd measuring points are 0.043±0.018, 0.109±0.0016 and 0.014±0.002, respectively, and are lower than the ranges of the normal model. Moreover, the time ratio of the 1st measuring point of FIG. 19, the time ratio of the 2nd measuring point of FIG. 20 and the time ratio of the 3rd measuring point of FIG. 21 are obviously different from the ranges of the normal model after 0 week after surgery, but are close to the ranges of the normal model after 8 weeks after surgery.

Figure 22:
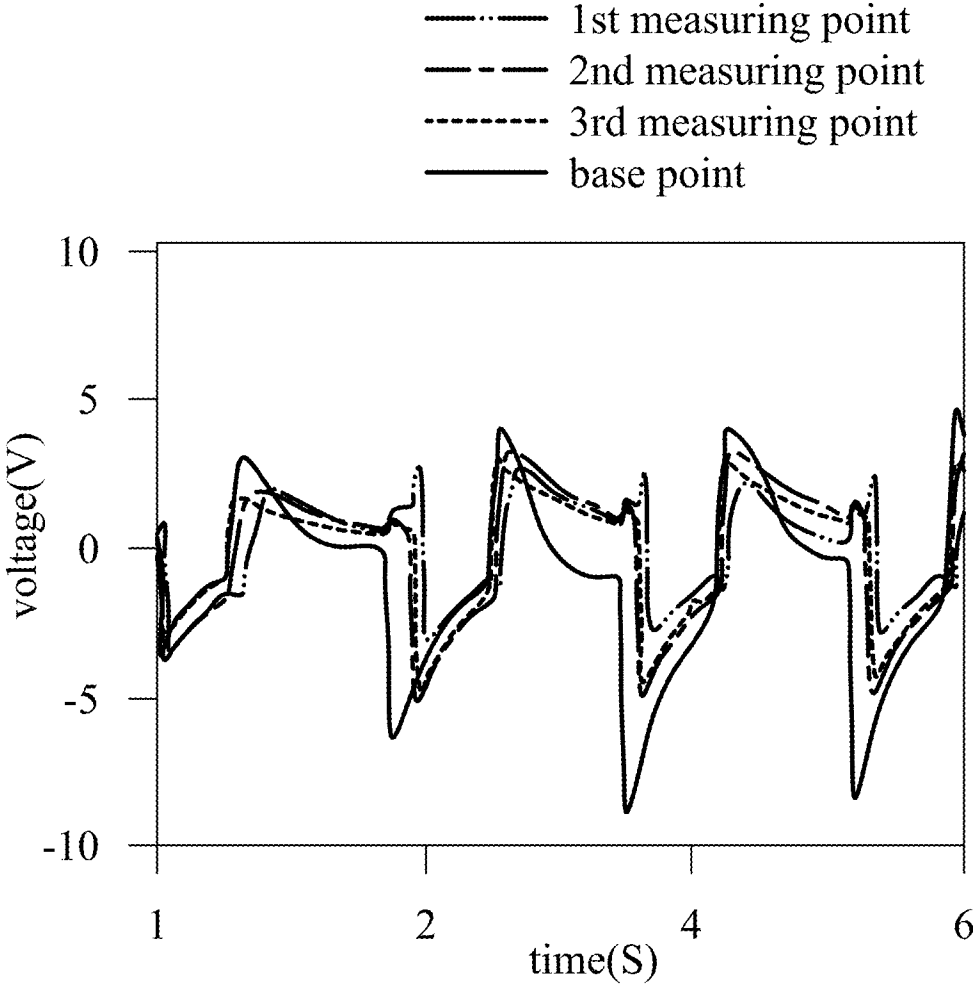
FIG. 22 is a voltage and time trend chart of triboelectric nanosensors of a 6th example of the gait measurement method of FIG. 6.
Figure 23:
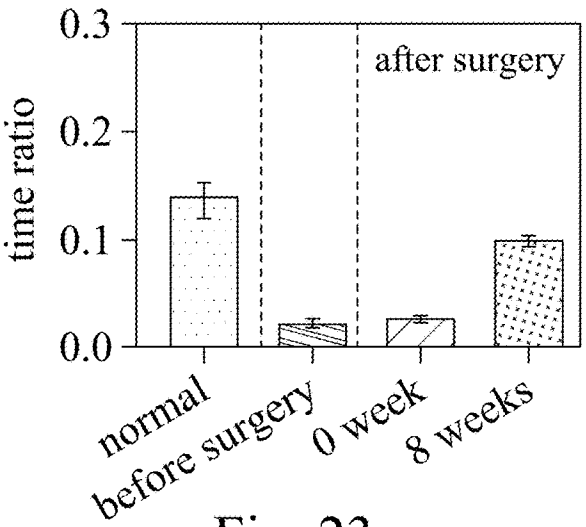
FIG. 23 is a comparison result between the time ratio of a 1st measuring point of the 6th example and one range of the normal model.
Figure 25:
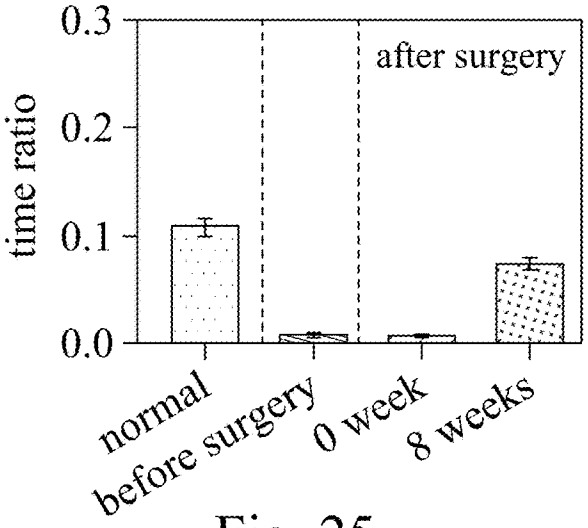
FIG. 25 is a comparison result between the time ratio of a 3rd measuring point of the 6th example and one range of the normal model.
Figure 24:
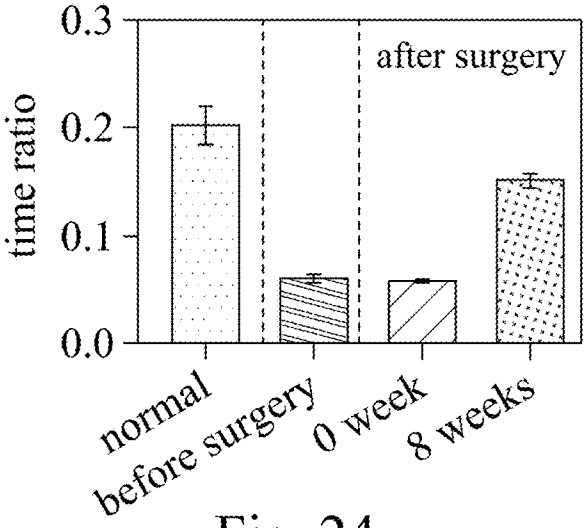
FIG. 24 is a comparison result between the time ratio of a 2nd measuring point of the 6th example and one range of the normal model.

FIG. 22 is a voltage and time trend chart of triboelectric nanosensors 2110, 2120, 2130, 2140 of a 6th example of the gait measurement method 2000 of FIG. 6. FIG. 23 is a comparison result between the time ratio of a 1st measuring point of the 6th example and one range of the normal model. FIG. 24 is a comparison result between the time ratio of a 2nd measuring point of the 6th example and one range of the normal model. FIG. 25 is a comparison result between the time ratio of a 3rd measuring point of the 6th example and one range of the normal model. In the 6th example, the tested person has a herniated disc at lumbar segment 4 and 5. After measurement and calculation, the time ratios of the 1st to 3rd measuring points are 0.021±0.003, 0.059±0.003 and 0.007±0.001, respectively, and deviate from the time ratios of the three ranges of the normal model. Measurement of the same tested person can be taken after 8 weeks after surgery, and the time ratios of the 1st to 3rd measuring points are 0.098±0.005, 0.150±0.006 and 0.073±0.005, respectively, and are close to the time ratios of the three ranges of the normal model. Moreover, the time ratio of the 1st measuring point of FIG. 23 the time ratio of the 2nd measuring point of FIG. 24 and the time ratio of the 3rd measuring point of FIG. 25 are obviously different from the ranges of the normal model after 0 week after surgery, but are close to the ranges of the normal model after 8 weeks after surgery.

Hence, judging whether the time ratios of the 1st to 3rd measuring points deviate from the ranges of the normal model is favorable for assisting the professionals to judge whether the relative muscles or nerves are abnormal, and monitor for rehabilitation or recovering after surgery can be continuously taken.

Based on the aforementioned embodiments, the configuration of the biomimetic shark placoid scale-shaped microstructures is favorable for reducing the adhesion of the liquid metal to increase the contact surface, thereby improving the output of the triboelectric nanosensor as well as the stability and increasing the life time. Moreover, because of the self-power capability, an outer power source is not required, and real-time measurements can be carried out without considering the test place. Furthermore, with the comparison between the time ratios of the 1st to 3rd measuring points and the ranges of the normal model, normal gaits or abnormal gaits can be effectively distinguished.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure covers modifications and variations of this disclosure provided they fall within the scope of the following claims.

What is claimed is:

1. A triboelectric nanosensor, comprising:

an elastic body, comprising:

an inner wall surrounding a chamber; and a plurality of biomimetic shark placoid scale-shaped microstructures adjacent to each other and disposed at least one portion of the inner wall;

a liquid metal located within the chamber and surrounded by the elastic body; and a wire electrically connected to the liquid metal;

wherein the elastic body is pressed to be deformed and restores to change a contact state between the liquid metal and the biomimetic shark placoid scale-shaped microstructures, thereby allowing a plurality of electrons to flow into the liquid metal via the wire or to flow out from the liquid metal via the wire.

2. The triboelectric nanosensor of claim 1, wherein the inner wall comprises an upper layer and a lower layer, and the biomimetic shark placoid scale-shaped microstructures are disposed at the lower layer.

3. The triboelectric nanosensor of claim 1, wherein each of the biomimetic shark placoid scale-shaped microstructures comprises a plurality of microgrooves, and a width of each of the microgrooves is ranged from 45.0 microns to 50.0 microns.

4. The triboelectric nanosensor of claim 3, wherein each of the biomimetic shark placoid scale-shaped microstructures further comprises a main-ridge and two sub-ridges, the main-ridge is located between the two sub-ridges, one of the microgrooves is formed between the main-ridge and one of the sub-ridges, a height of the main-ridge is ranged from 9.5 microns to 10.5 micros, and a height of each of the sub-ridges is ranged from 7.5 microns to 8.5 microns.

5. The triboelectric nanosensor of claim 1, wherein the elastic body is made of silicone.

6. The triboelectric nanosensor of claim 1, wherein the liquid metal is made of mercury-free alloy.

7. A gait measurement method, comprising:

a triboelectric nanosensor providing step, wherein four triboelectric nanosensors of claim 1 are disposed at a sock or an insole, the four triboelectric nanosensors correspond to a big toe, a first metatarsal, a fourth metatarsal and a heel of a foot, respectively, and each of the triboelectric nanosensors is signally connected to a processor;

a signal collecting step, wherein a signal is generated by each of the triboelectric nanosensors based on a force of the foot;

a time ratio calculating step, wherein the triboelectric nanosensors correspond to the big toe, the first metatarsal and the fourth metatarsal are defined as 1st to 3rd measuring points, respectively, the triboelectric nanosensor corresponds to the heel is defined as a base point, the processor calculates $Rai=(TX_i-TH)/CY$, Rai represents a time ratio of the ith measuring point, $TX_i$ represents a trigger time of the ith measuring point, CY represents a difference between a former one of the trigger times of the base point and a latter one of the trigger times of the base point, i represents a variant and is an integer ranged from 1 to 3, the trigger time indicates a time point that the signal starts, and the time ratios of the 1st to 3rd measuring points are obtained; and a time ratio comparing step, wherein the time ratios are compared to three ranges, respectively, by the processor to confirm whether each of the time ratios is within each of the ranges.

8. The gait measurement method of claim 7, wherein the inner wall comprises an upper layer and a lower layer, and the biomimetic shark placoid scale-shaped microstructures are disposed at the lower layer.

9. The gait measurement method of claim 7, wherein the inner wall comprises an upper layer and a lower layer, and the biomimetic shark placoid scale-shaped microstructures are disposed at the upper layer and the lower layer.

10. The gait measurement method of claim 7, wherein each of the biomimetic shark placoid scale-shaped microstructures comprises a plurality of microgrooves, and a width of each of the microgrooves is ranged from 45.0 microns to 50.0 microns.

11. The gait measurement method of claim 10, wherein each of the biomimetic shark placoid scale-shaped microstructures further comprises a main-ridge and two sub-ridges, the main-ridge is located between the two sub-ridges, one of the microgrooves is formed between the main-ridge and each of the sub-ridges, a height of the main-ridge is ranged from 9.5 microns to 10.5 micros, and a height of each of the sub-ridges is ranged from 7.5 microns to 8.5 microns.

12. The gait measurement method of claim 7, wherein the elastic body is made of silicone.

13. The gait measurement method of claim 7, wherein the liquid metal is made of mercury-free alloy.

14. The gait measurement method of claim 7, wherein one of the ranges is ranged from 0.12 to 0.14.

15. The gait measurement method of claim 7, wherein one of the ranges is ranged from 0.19 to 0.21.

16. The gait measurement method of claim 7, wherein one of the ranges is ranged from 0.09 to 0.11.

* * * * *